US010159999B2

(12) United States Patent
Ma et al.

(10) Patent No.: US 10,159,999 B2
(45) Date of Patent: Dec. 25, 2018

(54) HUB PAINT SPRAYING EQUIPMENT EQUIPPED WITH SPRAYING ROBOT HAVING COMBINED SPRAY GUN

(71) Applicant: CITIC Dicastal CO., LTD., Qinhuangdao, Hebei (CN)

(72) Inventors: Huanming Ma, Qinhuangdao (CN); Zhiwei Qin, Qinhuangdao (CN); Hongtao Wang, Qinhuangdao (CN); Bo Ning, Qinhuangdao (CN); Zaide Wang, Qinhuangdao (CN); Zhiliang Zhang, Qinhuangdao (CN); Yongwang Zhao, Qinhuangdao (CN)

(73) Assignee: CITIC DICASTAL CO., LTD., Qinhuangdao, Hebei (CN)

( * ) Notice: Subject to any disclaimer, the term of this patent is extended or adjusted under 35 U.S.C. 154(b) by 0 days.

(21) Appl. No.: 15/627,892

(22) Filed: Jun. 20, 2017

(65) Prior Publication Data

US 2018/0243777 A1 Aug. 30, 2018

(30) Foreign Application Priority Data

Feb. 25, 2017 (CN) ..... 2017 1 0105141

(51) Int. Cl.

| | |
|---|---|
| ***B05B 13/04*** | (2006.01) |
| ***B05B 7/12*** | (2006.01) |
| ***B05B 16/00*** | (2018.01) |
| ***B05B 12/16*** | (2018.01) |
| ***B05C 9/12*** | (2006.01) |

(Continued)

(52) U.S. Cl.

CPC ..... *B05B 13/0431* (2013.01); *B05B 7/1236* (2013.01); *B05B 12/16* (2018.02);

(Continued)

(58) Field of Classification Search

CPC ..... B05B 13/0431; B05B 16/00; B05B 12/16; B05B 7/1236; B05B 15/04; B05B 15/12;

(Continued)

(56) References Cited

U.S. PATENT DOCUMENTS 6,528,109 B1 * 3/2003 Filev ..... B05B 12/12 118/313
7,943,201 B2 * 5/2011 Hendricks, Sr. ..... B05B 12/122 118/316

(Continued)

FOREIGN PATENT DOCUMENTS

CN 1840240 A 10/2006
CN 104619427 A 5/2015

(Continued)

*Primary Examiner* — Laura Edwards

(74) *Attorney, Agent, or Firm* — Cooper Legal Group, LLC

(57) ABSTRACT

Disclosed is a hub paint spraying equipment equipped with a spraying robot having a combined spray gun, comprising a control system, a wheel type recognition system, a brace recognition system, a paint supply device, a quick color changing device, spraying robot, combined spray gun, a cleaning system, a conveying chain and an accessory device. Combined spray gun installed at the end of spraying robot of system is formed by assembling a plurality of spray gun individuals, spraying process and parameter are automatically called by automatic recognition of wheel type recognition system, category of a colored paint is automatically changed, spraying parameter and robot spraying path program are called, and mixed-line intelligent spraying of a hub is realized, so that problems of low utilization rate of equipment due to consumption of a lot of time for replacing colored paint and excessive in-process caused by classification and temporary storage stacking are avoided.

3 Claims, 3 Drawing Sheets

(51) Int. Cl.
*B05C 11/10* (2006.01)
*B05C 5/02* (2006.01)

(52) U.S. Cl.
CPC ..... *B05B 16/00* (2018.02); *B05C 9/12* (2013.01); *B05C 11/1044* (2013.01); *B05C 5/0208* (2013.01); *B05C 5/0212* (2013.01); *B05C 11/1039* (2013.01)

(58) Field of Classification Search
CPC ..... B06C 9/12; B05C 9/08; B05C 5/0208; B05C 5/0212; B05C 5/0225; B05C 5/027; B05C 11/1039; B05C 11/1044; B29D 30/0061; Y10S 901/43; Y10S 901/47
USPC ..... 118/302, 313, 326
See application file for complete search history.

(56) References Cited

U.S. PATENT DOCUMENTS

| | | | | |
|---|---|---|---|---|
| 2004/0129208 | A1* | 7/2004 | Nolte | B05B 12/1454 118/305 |
| 2010/0270394 | A1 | 10/2010 | Kwon | |
| 2014/0041578 | A1* | 2/2014 | Hendricks, Sr. | B29D 30/0061 118/326 |

FOREIGN PATENT DOCUMENTS

| | | | |
|---|---|---|---|
| CN | 205236269 | U | 5/2016 |
| CN | 105964440 | A | 9/2016 |
| CN | 106295936 | A | 1/2017 |
| CN | 206483626 | U | 9/2017 |
| EP | 0833694 | A1 | 4/1998 |

* cited by examiner

HUB PAINT SPRAYING EQUIPMENT EQUIPPED WITH SPRAYING ROBOT HAVING COMBINED SPRAY GUN

CROSS-REFERENCE TO RELATED APPLICATIONS

This application is filed based upon and claims priority to Chinese Patent Application No. 201710105141.3, filed on Feb. 25, 2017, the entire contents of which are incorporated herein by reference.

TECHNICAL FIELD

The disclosure relates to hub paint spraying equipment equipped with a spraying robot having a combined spray gun, and relates to the field of hub spraying technology.

BACKGROUND

At present, the robot spraying technology is increasingly widely applied in the automobile hub spraying field. In the traditional production mode of spraying robots, one robot is equipped with one spray gun, hubs to be sprayed need to be classified according to the types of sprayed paints and are collectively fed, i.e., produced in batch; when needing to spray a next hub colored paint, the colored paint must be replaced. In the traditional production mode, the equipment efficiency is reduced, and massive in-process is caused by the batch feeding mode. Under current market demands for progressive small batch and customization, the traditional spraying mode already cannot meet the requirements of flexible production, so a production mode and equipment for flexible spraying are urgently needed.

SUMMARY

Aiming at the above shortcomings of the prior art, the disclosure provides hub paint spraying equipment equipped with a spraying robot having a combined spray gun.

The technical solution for solving the technical problems adopted in the disclosure is that a hub paint spraying equipment equipped with a spraying robot having a combined spray gun includes a control system, a wheel type recognition system, a brace recognition system, a paint supply device, a quick color changing device, the spraying robot, the combined spray gun, a cleaning system, a conveying chain and an accessory device, in which the conveying chain includes a chain, braces and a driving mechanism, the braces being arranged on the chain. The equipment main body of the disclosure is arranged in a spraying isolation area, a spray room is arranged in the spraying isolation area, the spraying robot is arranged in the spray room, the wheel type recognition system is arranged in front of the entrance of the spraying isolation area, the brace recognition system includes read-write tags arranged below each brace and tag read-write devices arranged at the wheel type recognition system and the entrances of the spray room, and the wheel type recognition system and the tag read-write devices are connected with the control system by adopting weak current.

The combined spray gun is installed at the top of the spraying robot and formed by fixedly installing a plurality of spray gun individuals together, the relative positions of the spray gun individuals are fixed, the paint supply device is connected with the corresponding spray gun individuals via paint supply pipelines independent from each other according to the categories of colored paints, the quick color changing device is arranged on the paint supply pipelines, and the paint supply system and the quick color changing device are connected with the control system by adopting weak current.

The control system stores models and codes of hubs to be produced as well as categories of colored paints, spraying parameters and spraying robot path programs corresponding to the hubs to be produced, and controls the following spraying process: feeding a hub to be sprayed, recognizing the model of the hub, recognizing the brace, storing wheel type information, feeding the hub to be sprayed into the spraying isolation area, reading the brace, calling the category of the colored paint and the spraying parameter, selecting a spray gun individual, calling a path program (taking one of the spray gun individuals as a zero point, automatically transforming coordinates by adopting the relative displacement between the selected spray gun individual and the zero-point spray gun individual to obtain the final path program), spraying, leaving the spray room, braking and curing, and discharging the product.

Further, the paint supply system includes mixing stations and paint supply pumps corresponding to the spray gun individuals and independent from each other; the paint feeding path starts from a mixing station, then passes a paint supply pump, a paint feeding pipe, the quick color changing device, another paint feeding pipe and goes to a spray gun individual; and the paint return path starts from the quick color changing device, then passes a paint return pipe and goes to a mixing station.

Further, the cleaning system is arranged on the quick color changing device, the combined spray gun and the paint feeding pipe between the quick color changing device and the combined spray gun; and the cleaning system path sequentially includes a cleaner tank, a diaphragm pump, a cleaner delivery pipe, the quick color changing device, the paint feeding pipe, a spray gun individual, a waste paint return branch pipe, a waste paint return main pipe and a waste paint tank.

The disclosure has the advantages: the combined spray gun is installed at the end of the spraying robot of the system, the spraying process and parameter are automatically called by automatic recognition of the wheel type recognition system, the category of the colored paint is automatically changed, the spraying parameter and the robot spraying path program are called, and mixed-line intelligent spraying of the hub is realized, so that a lot of time for replacing the colored paint is avoided, the problem of excessive in-process caused by classification and temporary storage stacking is avoided, and the system meets current market demands for progressive small batch and customization.

LIST OF REFERENCE SYMBOLS

Figure 1:
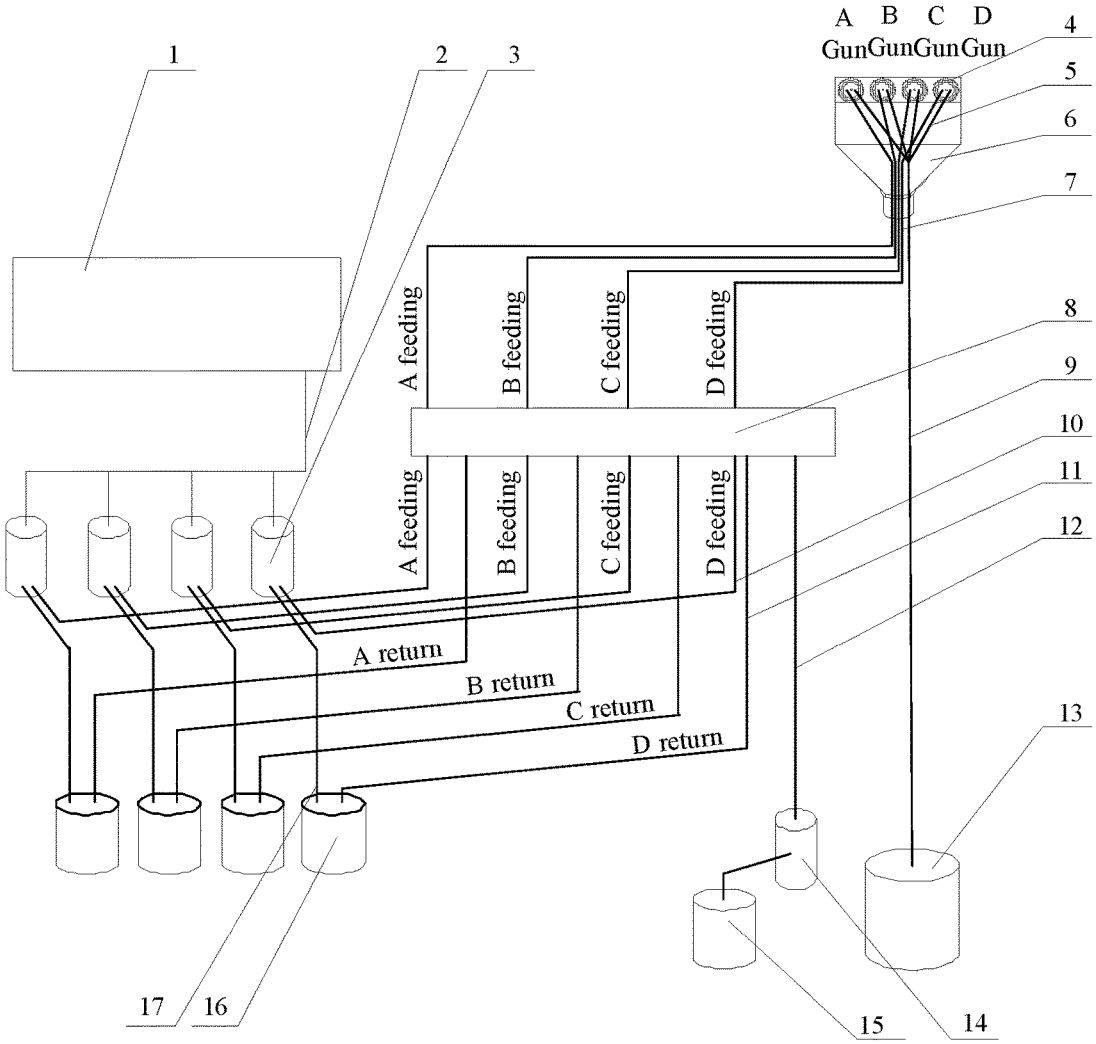
FIG. 1 is a schematic diagram of a system of the disclosure.

1 control system
2 weak electric wire
3 paint supply pump
4 spray gun individual

5 waste paint return branch pipe
6 combined spray gun
7 paint feeding pipe
8 quick color changing device
9 waste paint return main pipe
10 paint feeding pipe
11 paint return pipe
12 cleaner delivery pipe
13 waste paint tank
14 diaphragm pump
15 cleaner tank
16 mixing station
17 paint feeding delivery pipe
18 nozzle
19 spray gun main body
20 connecting seat
21 conveying chain and accessory device
22 wheel type recognition system
23 spraying isolation area
24 spray room
25 feeding area
26 coating curing area
27 discharging area
28 spraying robot
29 brace recognition system
30 brace

DETAILED DESCRIPTION

The disclosure will be further described in detail below in combination with embodiments and the accompanying drawings.

Figure 2:
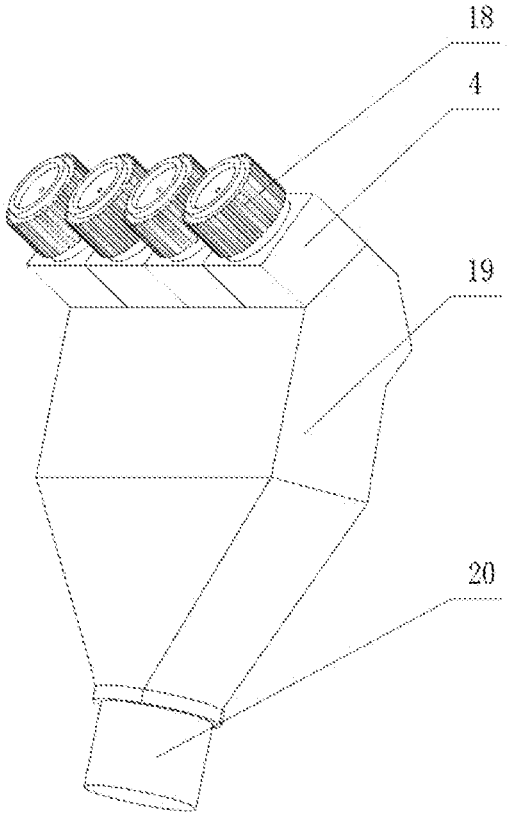
FIG. 2 is a schematic diagram of a combined spray gun of the disclosure.
Figure 3:
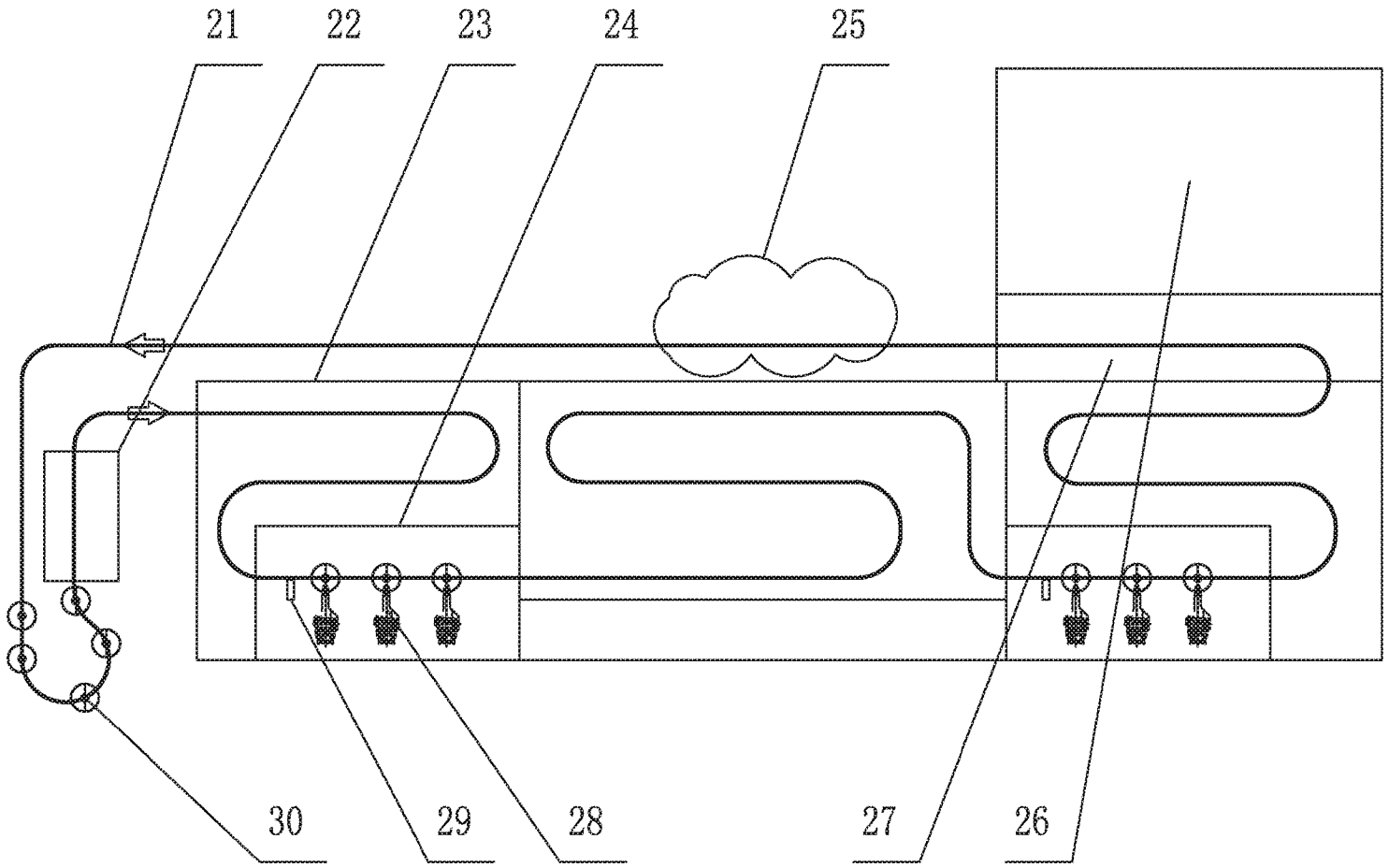
FIG. 3 is a schematic diagram of an arrangement of an equipment of the disclosure.

FIGS. 1 and 2 show hub paint spraying equipment equipped with a spraying robot having a combined spray gun, the equipment main body of the disclosure is arranged in a spraying isolation area, a spray room is arranged in the spraying isolation area, the spraying robot is arranged in the spray room, a wheel type recognition system is arranged in front of the entrance of the spraying isolation area, a brace recognition system includes read-write tags arranged below each brace and tag read-write devices arranged at the wheel type recognition system and the entrances of the spray room, and the wheel type recognition system and the tag read-write devices are connected with the control system 1 by adopting weak current.

A combined spray gun 6 is installed at the top of the spraying robot and formed by fixedly installing four spray gun individuals 4 together, the relative positions of the spray gun individuals 4 are fixed, a paint supply device is connected with the corresponding spray gun individuals 4 via paint supply pipelines independent from each other according to the categories of colored paints, a quick color changing device 8 is arranged on the paint supply pipelines, and the paint supply system and the quick color changing device 8 are connected with the control system 1 by adopting weak current.

The control system 1 stores models and codes of hubs to be produced as well as categories of colored paints, spraying parameters and spraying robot path programs corresponding to the hubs to be produced, and controls the following spraying process: feeding a hub to be sprayed, recognizing the model of the hub, recognizing the brace, storing wheel type information, feeding the hub to be sprayed into the spraying isolation area, reading the brace, calling the category of the colored paint and the spraying parameter, selecting a spray gun individual, calling a path program (taking one of the spray gun individuals as a zero point, automatically transforming coordinates by adopting the relative displacement between the selected spray gun individual and the zero-point spray gun individual to obtain the final path program), spraying, leaving the spray room, braking and curing, and discharging the product.

The paint supply system includes mixing stations 16 and paint supply pumps 3 corresponding to the spray gun individuals 4 and independent from each other; the paint feeding path starts from a mixing station 16, then passes a paint supply pump 3, a paint feeding pipe 10, the quick color changing device 8, a paint feeding pipe 7 and goes to a spray gun individual 4; and the paint return path starts from the quick color changing device 8, then passes a paint return pipe 11 and goes to the mixing station 16.

The cleaning system is arranged on the quick color changing device 8, the combined spray gun 6 and the paint feeding pipe 7 between the quick color changing device 8 and the combined spray gun 6; and the cleaning system path sequentially includes a cleaner tank 15, a diaphragm pump 14, a cleaner delivery pipe 12, the quick color changing device 8, the paint feeding pipe 7, a spray gun individual 4, a waste paint return branch pipe 5, a waste paint return main pipe 9 and a waste paint tank 13.

What is claimed is:

1. A hub paint spraying equipment equipped with a spraying robot having a combined spray gun, comprising a control system, a wheel type recognition system, a brace recognition system, a paint supply device, a quick color changing device, the spraying robot, the combined spray gun, a cleaning system, a conveying chain and an accessory device, wherein the conveying chain comprises a chain, braces and a driving mechanism, the braces being arranged on the chain, wherein the wheel type recognition system, the brace recognition system, the paint supply device, the quick color changing device, the spraying robot, the combined spray gun, the cleaning system and the conveying chain are controlled by the control system, wherein the cleaning system is arranged on the quick color changing device, the combined spray gun and a paint feeding pipe disposed between the quick color changing device and the combined spray gun, wherein a main body of the hub paint spraying equipment is arranged in a spraying isolation area, a spray room being provided in the spraying isolation area, the spraying robot being arranged in the spray room, the wheel type recognition system being arranged in front of an entrance of the spraying isolation area, the brace recognition system comprising read-write tags arranged below each brace and tag read-write devices arranged at the wheel type recognition system and entrances of the spray room, and the wheel type recognition system and the tag read-write devices being connected with the control system;

the combined spray gun being installed at a top of the spraying robot and formed by fixedly installing a plurality of spray gun individuals together, the relative positions of the spray gun individuals being fixed, the paint supply device being connected with the corresponding spray gun individuals via paint supply pipelines independent from each other according to categories of colored paints, the quick color changing device being arranged on the paint supply pipelines, and the paint supply device and the quick color changing device being connected with the control system.

2. The hub paint spraying equipment equipped with the spraying robot having the combined spray gun according to claim 1, wherein the paint supply device comprises mixing stations and paint supply pumps corresponding to the spray gun individuals and independent from each other; wherein a paint feeding path starts from a mixing station, then passes a paint supply pump, a paint feeding pipe, the quick color changing device, another paint feeding pipe and goes to a spray gun individual; and wherein a paint return path starts from the quick color changing device, then passes a paint return pipe and goes to the mixing station.

3. The hub paint spraying equipment equipped with the spraying robot having the combined spray gun according to claim 1, wherein a cleaning system path sequentially comprises a cleaner tank, a diaphragm pump, a cleaner delivery pipe, the quick color changing device, the paint feeding pipe, a spray gun individual, a waste paint return branch pipe, a waste paint return main pipe and a waste paint tank.

* * * * *